US011594389B2

(12) United States Patent
Gudeman et al.

(10) Patent No.: US 11,594,389 B2
(45) Date of Patent: Feb. 28, 2023

(54) MEMS DUAL SUBSTRATE SWITCH WITH MAGNETIC ACTUATION

(71) Applicant: Innovative Micro Technology, Goleta, CA (US)

(72) Inventors: Christopher S Gudeman, Lompoc, CA (US); Marin Sigurdson, Goleta, CA (US)

(73) Assignee: Innovative Micro Technology, Goleta, CA (US)

( * ) Notice: Subject to any disclaimer, the term of this patent is extended or adjusted under 35 U.S.C. 154(b) by 0 days.

(21) Appl. No.: 17/200,954

(22) Filed: Mar. 15, 2021

(65) Prior Publication Data

US 2021/0202196 A1 Jul. 1, 2021

Related U.S. Application Data

(63) Continuation-in-part of application No. 16/104,145, filed on Aug. 17, 2018, now abandoned.

(51) Int. Cl.

| | |
|---|---|
| ***H01H 50/00*** | (2006.01) |
| ***H01H 50/54*** | (2006.01) |
| ***H01H 49/00*** | (2006.01) |
| ***H01H 50/36*** | (2006.01) |
| ***H01H 50/64*** | (2006.01) |

(52) U.S. Cl.

CPC ..... *H01H 50/005* (2013.01); *H01H 49/00* (2013.01); *H01H 50/36* (2013.01); *H01H 50/54* (2013.01); *H01H 50/641* (2013.01)

(58) Field of Classification Search

CPC .... H01H 1/0036; H01H 50/005; H01H 11/00; H01H 2036/0093; H01H 2001/0084; H01H 2229/014; H01H 1/14; H01H 3/28; H01H 2001/0089; H01H 50/36; H01H 50/54; H01H 50/641; H01H 36/0006

See application file for complete search history.

(56) References Cited

U.S. PATENT DOCUMENTS

| | | | | |
|---|---|---|---|---|
| 5,475,353 | A * | 12/1995 | Roshen | H01H 50/005 200/512 |
| 6,486,425 | B2 | 11/2002 | Seki | |
| 6,778,046 | B2 * | 8/2004 | Stafford | B81B 7/0077 200/181 |
| 7,342,473 | B2 * | 3/2008 | Joung | H01H 50/005 200/181 |
| 7,528,691 | B2 | 5/2009 | Wallis et al. | |
| 7,785,913 | B2 | 8/2010 | Rybnicek et al. | |
| 7,864,006 | B2 | 1/2011 | Foster et al. | |
| 7,893,798 | B2 | 2/2011 | Foster et al. | |
| 8,810,341 | B2 * | 8/2014 | Bachman | H01H 50/005 335/78 |

(Continued)

*Primary Examiner* — Mohamad A Musleh
(74) *Attorney, Agent, or Firm* — Jaquelin K. Spong

(57) ABSTRACT

Systems and methods for forming a magnetostatic MEMS switch include forming a movable beam on a first substrate, forming the electrical contacts on a second substrate, and coupling the two substrates using a hermetic seal. A shunt bar on the movable plate may close the switch when lowered onto the contacts. The switch may generally be closed, with the shunt bar resting on the contacts. However, a magnetically permeable material may also be inlaid into the movable plate. The switch may then be opened by placing either a permanent magnet or an electromagnet in proximity to the switch.

10 Claims, 19 Drawing Sheets

(56) References Cited

U.S. PATENT DOCUMENTS

| | | | | |
|---|---|---|---|---|
| 9,601,280 | B2 * | 3/2017 | Bachman | H01H 50/58 |
| 2004/0113727 | A1 * | 6/2004 | Kawai | H01P 1/127 335/78 |
| 2007/0007952 | A1 * | 1/2007 | Shen | H01H 36/002 324/207.26 |
| 2011/0130721 | A1 * | 6/2011 | Foster | B81C 1/0023 604/151 |
| 2011/0155548 | A1 * | 6/2011 | Foster | H01H 59/0009 200/181 |
| 2012/0103768 | A1 * | 5/2012 | Bachman | H01G 5/18 200/181 |
| 2015/0069618 | A1 | 3/2015 | Gudeman et al. | |
| 2016/0093530 | A1 | 3/2016 | Harley et al. | |

* cited by examiner 10, 12
220
222

220
260
222
1400
200

MEMS DUAL SUBSTRATE SWITCH WITH MAGNETIC ACTUATION

CROSS REFERENCE TO RELATED APPLICATIONS

This nonprovisional U.S. patent application is a continuation-in-part, claiming priority to U.S. nonprovisional patent application Ser. No. 16/104,145, filed Aug. 17, 2018, which in turn claims priority to U.S. Provisional Application Ser. No. 62/550,588, filed Aug. 26, 2017. These prior applications are incorporated by reference in its entirety.

STATEMENT REGARDING FEDERALLY SPONSORED RESEARCH

Not applicable.

STATEMENT REGARDING MICROFICHE APPENDIX

Not applicable.

BACKGROUND

This invention relates to a microelectromechanical systems (MEMS) magnetic switch device, and its method of manufacture. The MEMS switch, may be magnetically actuated, and opens or closes contacts to activate a circuit.

Microelectromechanical systems (MEMS) are devices often having moveable components which are manufactured using lithographic fabrication processes developed for producing semiconductor electronic devices. Because the manufacturing processes are lithographic, MEMS devices may be made in very small sizes, and in large quantities. MEMS techniques have been used to manufacture a wide variety of sensors and actuators, such as accelerometers and electrostatic cantilevers.

MEMS techniques have also been used to manufacture electrical relays or switches of small size, generally using an electrostatic actuation means to activate the switch. MEMS devices often make use of silicon-on-insulator (SOI) wafers, which are a relatively thick silicon "handle" wafer with a thin silicon dioxide insulating layer, followed by a relatively thin single crystal silicon "device" layer. In the MEMS devices, a thin movable plate of silicon may be etched into the silicon device layer, and a cavity is created adjacent to the thin beam, typically by etching the thin silicon dioxide layer below it to allow for the electrostatic deflection of the beam. Electrodes provided above or below the beam may provide the voltage potential which produces the attractive (or repulsive) force to the movable plate, causing it to deflect within the cavity.

MEMS switches generally rely on some method of applying a force to a beam in order to drive the contacts closed on a normally open switch, or open on a normally closed switch. Counter-acting springs that are incorporated into the structure then open the switch when the force is removed.

One known embodiment of such an electrostatic relay is disclosed in U.S. Pat. No. 6,486,425 to Seki. The electrostatic relay described in this patent includes a fixed substrate having a fixed terminal on its upper surface and a moveable substrate having a moveable terminal on its lower surface. Upon applying a voltage between the moveable electrode and the fixed electrode, the moveable substrate is attracted to the fixed substrate such that an electrode provided on the moveable substrate contacts another electrode provided on the fixed substrate to close the microrelay.

Another prior art device is described in U.S. Pat. No. 7,528,691, issued May 5, 2009 and assigned to the same assignee as the instant applications. In this reference two substrates are bonded together to form the switch. A movable plate is formed on one substrate, and attached to the substrate by a set of restoring springs. A pair of fixed contacts is formed on a second substrate. A shunt bar on the movable plate is dimensioned to span the contacts when the movable plate is pressed against the second substrate. The movable plate with shunt bar is drawn toward the fixed contacts on the second substrate electrostatically when a voltage potential is applied between the plate and the substrate.

These two references describe a type of switch is generally referred to as "normally open", since the contacts are open when no force is applied. Such MEMS switches often use an electrostatic force to attract a movable plate toward a fixed plate. A voltage of 50-100V is needed to generate a force of approximately 100 microNewtons, which overcomes the support spring restoring force and stores energy in these springs so the switch can be opened when the voltage is turned off. More generally, MEMS switches that rely on force to close the contacts generally require an expensive power supply or battery to drive the high voltage or high current to generate this force. For many applications, the power source is not available or practical.

Accordingly, for many applications a switch that does not require such high voltages is needed. Also, a "normally closed" switch may be preferable for many reasons, including shipping, shock and vibration robustness.

Other microfabricated switches have been described, which used magnetic actuation. For example, U.S. Ser. No. 16/104,145 (the '145 application) describes a switch formed on two separate substrates which are then bonded together to form the switch. The '145 application is incorporated by reference in its entirety. This 'However, magnetic materials have properties which must be accounted for when designing such a device.

When a magnetic field is applied to a magnetic circuit, such as a switch, relay or magnetic field sensor, North and South magnetic poles tend to accumulate on opposite ends of the device. For large devices, such as motors and generators, which are comprised of magnetically permeable structures that are centimeters to meters in dimension, this accumulation of poles has little effect on the performance of the device. As the device size is reduced, as in MEMS applications, the pile up of poles can create a magnetic field of its own. The vector of this field generally points in the direction that opposes the externally applied field and thus tends to diminish the net magnetic flux that flows through the permeable structures. For relays, switches, field sensors, motors and generators, performance is enhanced with increased flux. In the case of microscopic magnetic devices, the close proximity of the North and South pole clusters can create a demag field that renders the device nonfunctional. Therefore, the understanding of these demag fields and methods to abate them are essential.

Although the abatement of demagnetization fields is essential, it is not sufficient. Efficient use of the often-weak field that is available is important, particularly when the device is small and thus it's cross-section in the field is small. For devices, such as switches, that are mechanically actuated by an external magnetic field, a flux guide, which routes and concentrates the magnetic field is needed. Additionally, movable structures that permit the mechanical actuation of devices, for instance switches, must be designed and implemented. These movable structures must contain a substantial volume of permeable material to promote low magnetic reluctance of the magnetic circuit. Thus, integration of the permeable material with the flexible structures is necessary. In some cases, the permeable material itself can be employed as the flexure, however magnetically permeable materials are generally microcrystalline metals, which suffer from fatigue and creep with long and repeated usage. Silicon, on the other hand, is monocrystalline and thus far superior a material for flexures. A reliable design where adequate permeable metal is embedded within a Si flexure is needed.

Yet another challenge lies in design and fabrication of MEMS magnetic switch specifically is reliability. The single most important factor in the design of a MEMS switch is the contact material. Almost universally the MEMS industry is now using a thin layer of RuO2 on surface of each contact. This metal oxide is highly conductive and thermodynamically stable. However, many MEMS switch architectures preclude the use of RuO2. Often the switch contacts are fabricated as part of a sandwich stack of layers. The contacts themselves are finally exposed at the very end of a manufacturing process and are therefore occluded from line of sight deposition and cleaning. Thus, the design and production process must provide clear access to the contacting surfaces.

SUMMARY

The device described here is a switch that may be configured either as a "normally closed" switch that, in the quiescent position, there is an electrical path between the fixed contacts, or as a "normally open" switch wherein there is no path in the quiescent position. For the normally closed switch, when the actuation force is applied to the movable plate, the plate (and shunt bar) are lifted up and off the contacts, opening the switch. For the normally open switch, the movable plate (and shunt bar) are generally held aloft of the contacts until the switch is actuated. The actuating force may be magnetic.

Large scale electromagnetic switches are known, such as Reed relays. Electromagnetic forces used in Reed relays may require high currents; typically 30 mA are needed to generate sufficient force to overcome the supporting spring counter-force.

However, the systems described here have a novel architecture and small size, such that no power source is needed or much more modest currents are needed.

The device described here may have a movable plate with a magnetically permeable material inlaid into the movable plate or into surrounding substrate material in one or the other of the two substrates. This permeable magnetic material may serve to concentrate and guide the flux from a source of magnetic flux in the vicinity of the movable plate. Accordingly, in the presence of the magnetic field, the movable plate is moved by attraction to the flux lines exiting the source. The movable plate may be disposed adjacent to a pair of fixed contacts formed on a second substrate. Thus, the movable plate may either be raised or lowered, depending on the configuration of the switch.

In one embodiment, in the quiescent position, the movable plate with shunt bar may rest on the contacts such that the switch is normally closed. When an external electromagnet is energized or a permanent magnet is brought into proximity, the magnet may create a magnetic field in the vicinity of the movable plate with inlaid permeable material. Because of the well-known behavior of permeable magnetic materials in the presence of a magnetic gradient, the inlaid permeable material may be drawn toward the magnet. With a properly positioned magnet (above the plate and away from the contacts), the movable plate will be lifted off of the fixed contacts, thereby opening the switch.

In another embodiment, in the quiescent position, the movable plate with shunt bar may be held aloft of the contacts such that the switch is normally open. When an external electromagnet is energized or a permanent magnet is brought into proximity, the magnet may create a magnetic field in the vicinity of the movable plate with inlaid permeable material. Because of the well known behavior of permeable magnetic materials in the presence of a magnetic gradient, the inlaid permeable material may be drawn toward the magnet. With a properly positioned magnet (below the plate and adjacent the contacts), the movable plate will be pulled onto the fixed contacts, thereby closing the switch.

Several embodiments of this concept are discussed below, including the orientations of the electromagnet and the use of a permanent magnet rather than an electromagnet. In The improvement disclosed here, the use of shaped permeable features is disclosed, wherein the plan view shape of the permeable flux guides is designed to focus and concentrate the flux in the vicinity of the movable shunt bar. The may greatly increase the pull down force achievable.

Accordingly, a magnetic MEMS device is disclosed, which may include a movable plate formed on a first substrate, wherein the movable plate is coupled to the first substrate by a plurality of restoring springs, and at least two electrical contacts formed on a second substrate. A conductive shunt bar may be disposed on the movable plate, dimensioned so as to span the two contacts. The magnetic MEMS device may also include at least one permeable magnetic feature inlaid into at least one of the first and the second substrates wherein the permeable magnetic material has a non-uniform cross section, and a seal which couples the first substrate to the second substrate, and seals the MEMS switch, such that the MEMS switch operated by disposing a source of magnetic field gradient in a vicinity of the magnetic MEMS switch, wherein the gradient is sufficient to move the movable plate and open or close the switch.

In some embodiments, the permeable magnetic feature may have a non-uniform cross section, wherein the cross section is smaller in areas near the shunt bar and contacts. In some embodiments, the permeable feature may have an elliptical shape, which guides and concentrates the lines of magnetic flux in the vicinity of the shunt bar and contacts. This may improve or increase the contact force applied between the shunt bar and the contacts, thus reducing the contact resistance and improving the reliability of the switch.

A method is also disclosed for fabricating the magnetic MEMS switch. The method may include forming a movable plate on a first substrate, wherein the movable plate is coupled to the first substrate by a plurality of restoring springs, forming at least two electrical contacts on a second substrate. The method may also include forming an inlaid magnetic material on at least one of the first and the second substrates, and coupling the first substrate to the second substrate with an adhesive bond that seals the MEMS switch.

These and other features and advantages are described in, or are apparent from, the following detailed description.

BRIEF DESCRIPTION OF THE DRAWINGS

Various exemplary details are described with reference to the accompanying drawings, which however, should not be taken to limit the invention to the specific embodiments shown but are for explanation and understanding only.

FIG. 9 shows the starting substrate;

FIG. 10 shows the cavities for the permeable material inlay;

FIG. 11 shows the secondary permeable material inlaid and the primary flux guides also formed;

FIG. 12 shows the shunt bar formed;

FIG. 13 shows the bondline formed on the plate substrate;

FIG. 14 shows the completed switch with the plate substrate bonded to the via substrate;

FIG. 15 shows the starting substrate for FIG. 8 with cavities for the permeable material inlay and the vias;

FIG. 16 shows the permeable material filling the cavities;

FIG. 17 shows the plated and planarized vias;

FIG. 18 shows the conductive pads deposited over top;

FIG. 19 shows the spacer formed on the via substrate;

FIG. 20 shows the switch wafer bonded to the via substrate;

FIG. 21 shows the dual substrate assembly with the backside of the vias substrate ground down to expose the through wafer vias;

FIG. 22 shows the completed switch with the plate substrate bonded to the via substrate;

It should be understood that the drawings are not necessarily to scale, and that like numbers maybe may refer to like features.

DETAILED DESCRIPTION

Figure 1:
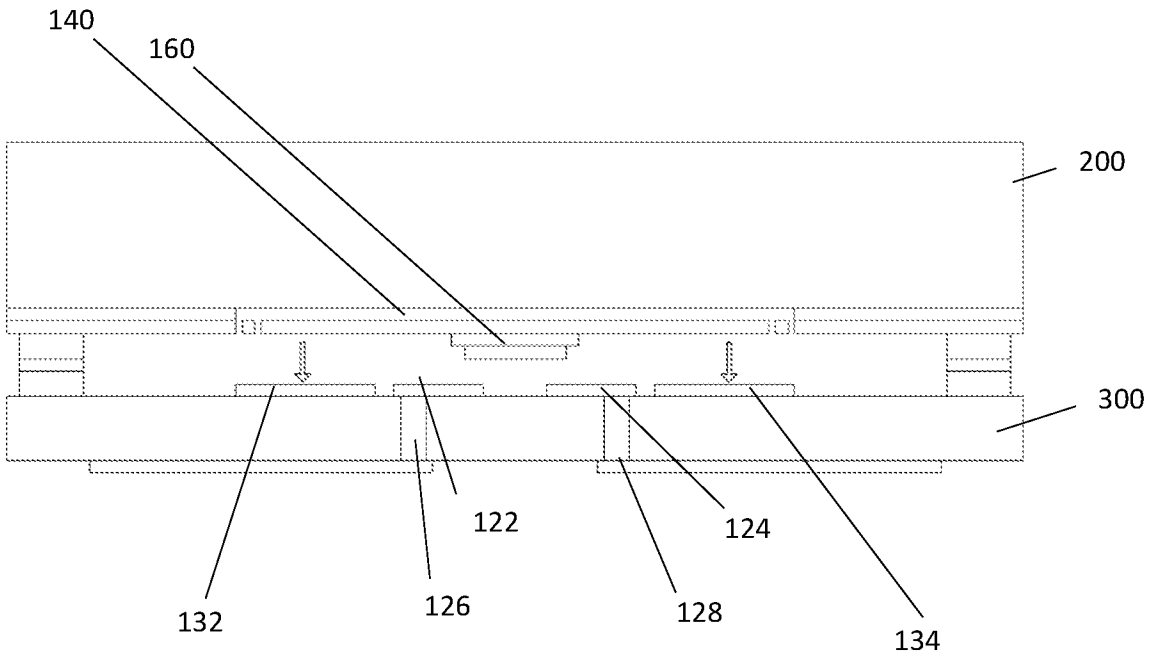
Fig. 1 (Prior Art)
FIG. 1 is an illustrative conceptual view of a prior art dual substrate MEMS device.

We describe here a MEMS switch that can address the problems described above. This switch can be fabricated in process similar to that of the Dual Substrate MEMS Switch (U.S. Pat. No. 7,893,798 B2), incorporated by reference in its entirety. However, there are at least two distinct differences:

1) Currently the sum of bond line thicknesses of the via wafer and the switch wafer are controlled so that after bond, the contact spacing is roughly 1 micrometer. In the new embodiment the sum of the thicknesses will be reduced by roughly 1.5 micrometers. Thus after bond, the contacts will be closed and loaded by the 0.5 micrometer over-travel. Springs of the appropriate force constant can provide the requisite load of ~100-300 microNewtons.
2) A layer of magnetically permeable material or a layer of permanent magnet material is deposited on the movable plate or in the surrounding substrate material. When the device is exposed to an externally generated magnetic field gradient, the beam is pulled in the direction of increasing field strength. This external magnetic field can be provided by a very small permanent magnet, and thus no electrical power is required, or it can be provided by an external electromagnet The following discussion presents a plurality of exemplary embodiments of the novel photolithographically fabricated dual substrate MEMS magnetic switch. The following reference numbers are used in the accompanying figures to refer to the following:

100, 101, 102, 103, 104 exemplary embodiments
2000 plate substrate
200 plate substrate material
3000 via substrate
300 via substrate material
124, 126 filled through substrate vias
232, 234 external contact pads
240 movable plate
260 shunt bar on movable plate
250 source of magnetic flux
265 coil for electromagnet
220, 222 primary fluxguides
224, 226 contact pads
10, 12 secondary flux guides
10", 12" optimized secondary flux guides
220" optimized primary flux guide
224, 226 electrical vias
1150 dielectric standoff
1400 bondline
2400 raised feature in bondline FIG. 1 shows a prior art electrostatic MEMS plate switch using dual substrates. In this device, the movable plate 140 is formed on a first SOI substrate 100 and the fixed contacts may be formed on a second silicon substrate 200. When the first substrate 100 is bonded to the second substrate 200, the switch is formed.

The movable plate 140 may have an electrical shunt bar 160 formed thereon, wherein the electrical shunt bar 160 may provide an electrical connection between two contacts 122, 124 of the switch, when the switch is actuated. These contacts may be fixed, and may be formed on a second substrate 300. In addition to the contacts 122, 124 there may also be an electrostatic actuating plate 132, 134, formed on the second substrate. When a voltage is applied between the movable plate 140 and the electrostatic actuating plates 132, 134, the movable plate 140 is drawn toward the second substrate, until the shunt bar spans the contacts, thus closing the switch.

It should be understood that the designation of "first", "second", "upper" and "lower" are arbitrary, that is, the plate may also be formed on an upper substrate and the contacts may be formed on a lower substrate. The terms "wafer" and "substrate" are used interchangeably herein, to refer to a supporting member, generally flat and circular, often of a semiconductor material such as silicon, as is well known in the art. As used herein, the term "fluxguide" should be understood to mean a generally planar quantity of permeable material, which is capable of collecting and concentrating lines of flux generated by a source of magnetic flux. A permeable material is given its usual definition, as a material with a magnetic permeability of at least 500.

Accordingly, in the absence of such an applied voltage, the plate is retracted from the contacts by a set of restoring springs, thereby opening the switch. That is, if the voltage is not applied, the movable plate 160 is raised by the restoring springs such that there is no longer an electrical connection between the two contacts 122, 124, and the switch is "normally open".

As is often the case with such switches, a voltage of 50-100V is needed to generate a force of approximately 100 microNewtons, which overcomes the support spring restoring force and stores energy in these springs so the switch can be opened when the voltage is turned off. More generally, MEMS switches that rely on electrostatic forces to close the switch generally require a power supply or battery to drive the high voltage or high current to generate this force. On many applications, a power source is not available or practical.

The switch described here uses a similar dual substrate architecture yet is not electrostatic in nature. Instead, the switch described here uses magnetic forces to actuate the switch. The magnetic MEMS switch may either be configured as a normally open switch, or it may be configured as a normally closed switch. The magnetic MEMS switch uses a source of magnetic flux such as a permanent magnet or an electromagnet, to open and close the switch. Several embodiments of the magnetic MEMS switch are described below.

Exemplary Embodiments with Primary Fluxguides

In the following discussion, reference number 200 refers to the substrate material used to create the movable plate structure 2000. The completed movable plate structure along with supporting features such as metallization pads, deposited and patterned materials, etc. is referred to as plate substrate or plate structure 2000. Similarly, reference number 300 refers to the substrate material used to create the via structure 3000. The completed via structure along with supporting features such as metallization pads, deposited and patterned materials, etc. is referred to as via substrate or via structure 3000.

Figure 2:
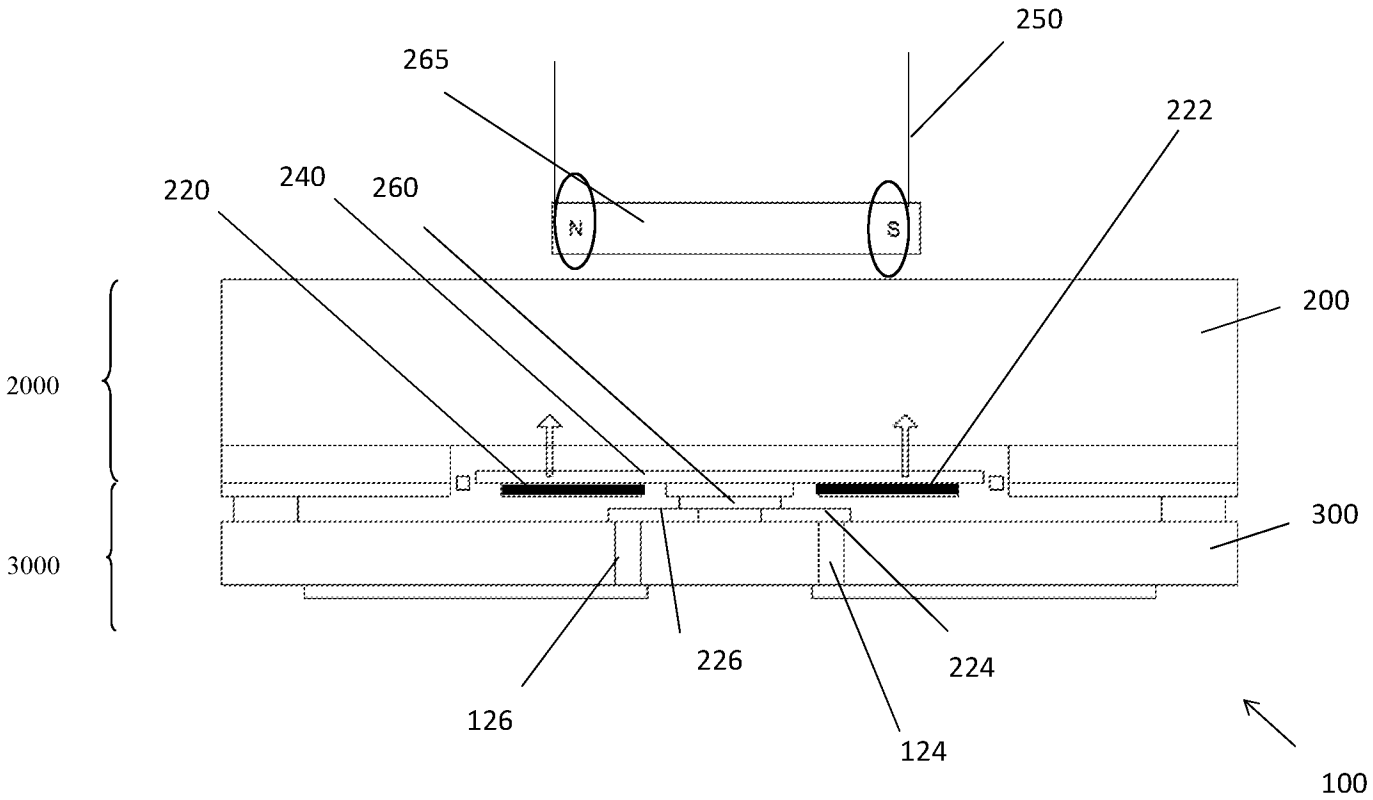
FIG. 2 an illustrative conceptual view of a first embodiment of a dual substrate magnetically actuated MEMS device which is normally closed, FIG. 3 an illustrative conceptual view of a another embodiment of a dual substrate magnetically actuated MEMS device, with an electromagnetic source of flux, normally closed.

FIG. 2 illustrates the magnetic MEMS switch in a cross sectional view. Once again, there may be a movable plate 240 formed on a first substrate 200, The movable plate 240 may also have at least one electrical shunt bar 260, which is dimensioned to provide an electrical connection between two contacts 226 and 224 of a switch. These contacts may be fixed, and may be formed on a second substrate 3000. Like the prior art device, the magnetic MEMS switch may also have two fixed electrical contacts 226 and 224 pads disposed over a metal through silicon via (TSV) 126 and 124.

The MEMS switch in this instance, may be a magnetically actuated device. In this case, the movable plate 240 may have a magnetically permeable material 220 and 222, inlaid into, or deposited on, the movable plate structure 240. For ease of fabrication, the permeable material may be disposed on the inner surface of the movable plate 240, wherein the term "inner surface" refers to the surface closest to the fixed contacts 226 and 224 on the assembled device. Fabrication of the permeable structures 220 and 222 will be described further below. These permeable features disposed on the movable plate 240 are referred to as "primary" fluxguides, and depicted in FIGS. 2-6. These flux guides are distinct from secondary flux guides which may be larger and inlaid into the substrate material itself. The secondary fluxguides are illustrated in FIGS. 7 and 8.

As mentioned, a movable suspended plate 240 may be disposed above the fixed adjacent contact electrodes 226 and 224. These contact electrodes may be in electrical communication with two through substrate vias (TSVs) 126 and 124. There may a similar conducting bonding pad on the exterior of the switch, for electrical attachment to other devices and equipment.

As before, a movable plate 240 with at least one electrical shunt bar 260 is formed on a first substrate 200. A pair of fixed contacts 226 and 224 is disposed on the second substrate After forming these structures, the two substrates are bonded together to form the switch.

In the quiescent state, the movable plate may rest on the contacts 226 and 224, such that a conductive path exists between contacts 226 and 224. In other words, in the quiescent state, the switch is closed.

A source of magnetic flux 250 may be disposed over the top of the first substrate 200. The flux will have a gradient associated with it. As is well known from magnetostatics, a permeable material will be drawn into an area with diverging (or converging) lines of flux. Accordingly, upon activation of the electromagnet, the permeable material will concentrate flux into the region and be pulled into areas of high flux gradient. The movable plate will thereby be drawn up and off of the electrical contacts 226 and 224 and towards the electromagnet.

The electromagnet may be the source of flux and may be activated by applying a current to a solenoidal coil 250 wrapped around a permeably magnetic core 265. The coil may create a field with field lines flowing along the axis of the coil, which is amplified by the permeable magnetic material in the core. The field lines exit and diverge at the north pole of the electromagnet, enter and converge at the south pole.

Figure 3:
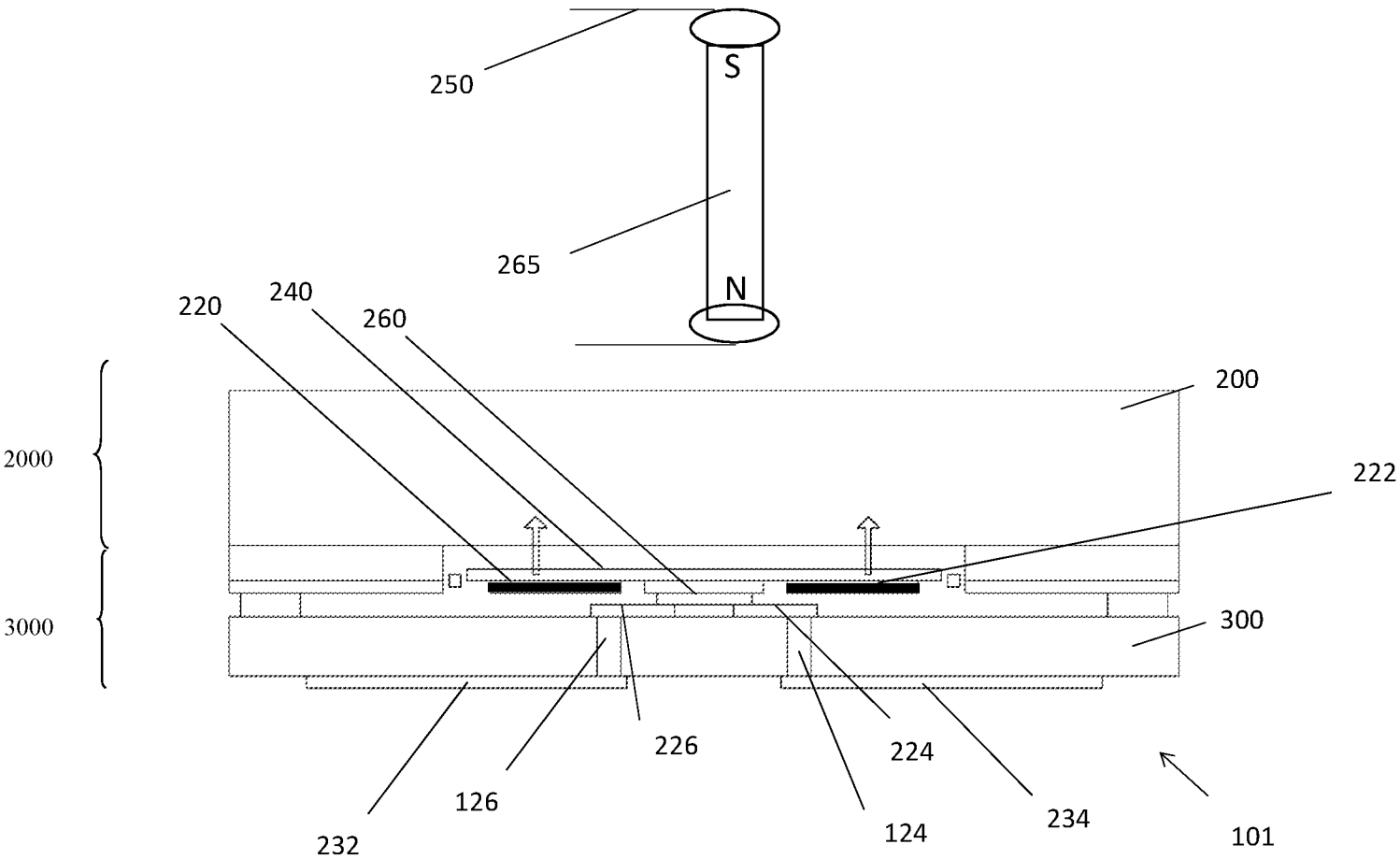

Another embodiment of the magnetic MEMS switch 101 is shown conceptually in FIG. 3. In this case again, the movable plate may have a magnetically permeable material 220 and 222, inlaid into the movable plate structure 240, as primary fluxguides.

The movable suspended plate 240 may be disposed above the fixed adjacent contact electrodes 226 and 224. These contact electrodes may be in electrical communication with two through substrate vias (TSVs) 126 and 124. There may be a conducting bonding pad on the exterior of the switch, for electrical attachment to other devices and equipment.

A first substrate 200 supports the movable plate 240 with at least one electrical shunt bar 260. As before, a permeable material 220, 222 is deposited adjacent the shunt bar. A pair of fixed contacts 226 and 224 is disposed on the second substrate 300. After forming these structures, the two substrates are bonded together to form the switch.

In the quiescent state, the movable plate may rest on the contacts 226 and 224, such that a conductive path exists between contacts 226 and 224. In other words, in the quiescent state, the switch is closed A source of magnetic flux 250 may be disposed over the top of the first substrate 200. The flux will have a gradient associated with it. As is well known from magnetostatics, a permeable material will be drawn into an area having a gradient in the flux field, that is, into areas where the flux line are diverging or converging. Accordingly, upon activation of the electromagnet, the movable plate will be drawn up and off of the electrical contacts 226 and 224 and towards the electromagnet, because of the presence of the permeable material 220 and 222.

The electromagnet may be the source of flux and may be activated by applying a current to a solenoidal coil 250 wrapped around a permeable magnetic core 265. However, in this embodiment, the source of flux is rotated 90 degrees such that a magnetic pole is in closest proximity to the movable plate 240. That is, lines of flux will be emitted from the north end of the electromagnet and return in the far field to the southern end. Such an orientation may have a larger field gradient and thus be more effective in producing the flux gradient for interacting with the permeable material 222, 220. The source of flux, electromagnet 250, may be oriented such that the field lines exit the north pole closest to the switch wafer 2000 and reenter the south pole further away from the switch wafer 2000. It should be understood that this orientation is arbitrary, and the source may also be oriented with its south pole closest to the switch wafer 2000.

Figure 4:
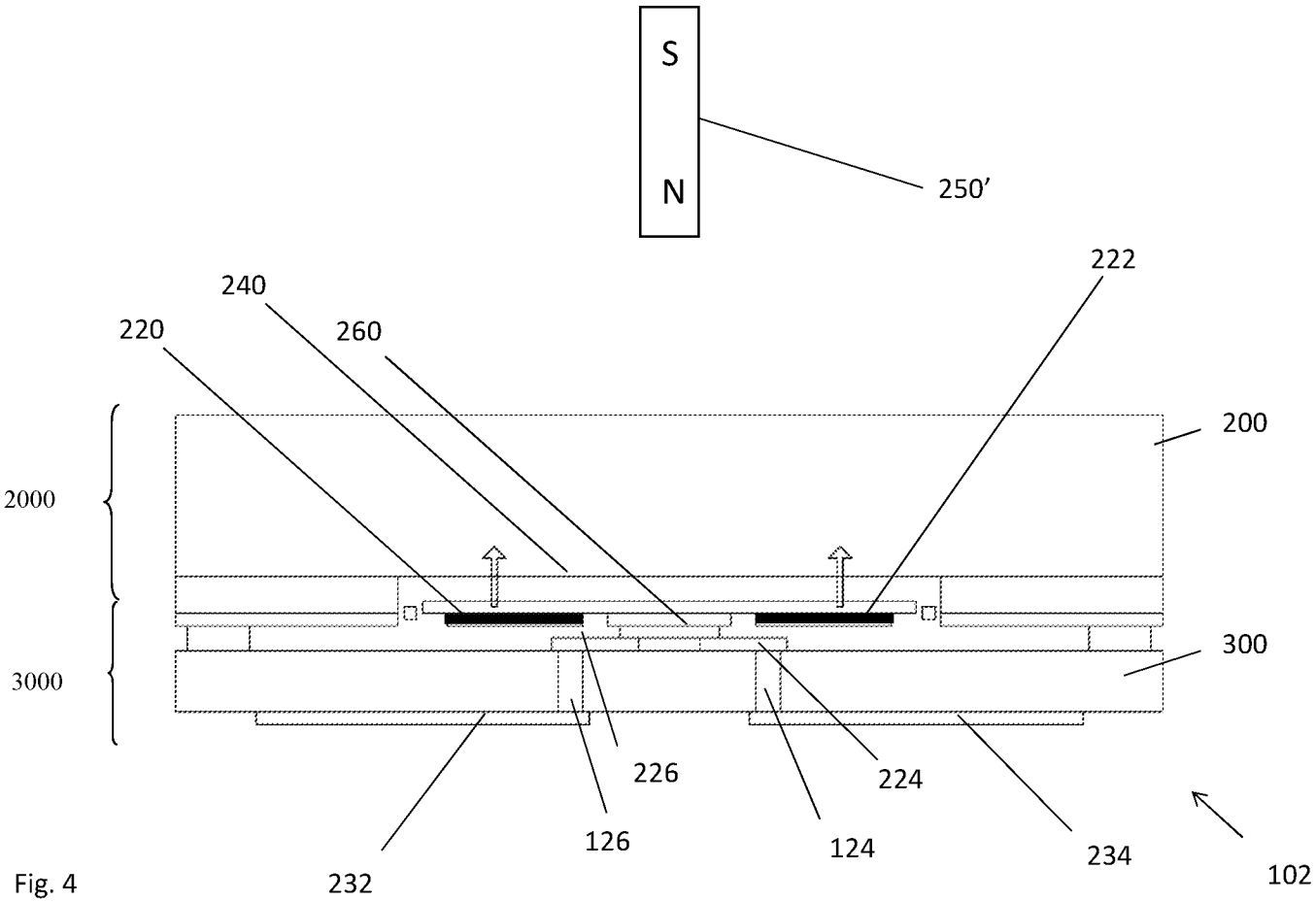
FIG. 4 an illustrative conceptual view of another embodiment of a dual substrate MEMS magnetically actuated device with a permanent magnet as the source of magnetic flux.

Another embodiment of the magnetic MEMS switch 102 is shown conceptually in FIG. 4. In this case again, the movable plate may have a magnetically permeable material 220 and 222, inlaid into or deposited on, the movable plate structure 240.

The movable suspended plate 240 may be disposed above the fixed adjacent contact electrodes 226 and 224. These contact electrodes may be in electrical communication with two through substrate vias (TSVs) 126 and 124. There may be conducting bonding pads 232 and 234 on the exterior of the switch, for electrical attachment to other devices and equipment.

As before, a first substrate 200 supports the movable plate 240 with at least one electrical shunt bar 260. A permeable material 220, 222 is deposited adjacent the shunt bar. A pair of fixed contacts 226 and 224 is disposed on the second substrate 300. After forming these structures, the two substrates are bonded together to form the switch.

These structures together define the plate substrate 2000 and the via substrate 3000. After forming these structures, the two substrates 2000 and 3000 are bonded together to form the switch.

In the quiescent state, the movable plate 240 may rest on the contacts 226 and 224, such that a conductive path exists between contacts 226 and 224. In other words, in the quiescent state, the switch is closed.

A source of magnetic flux may be disposed over the top of the first substrate 2000. The flux will have a gradient associated with it. As is well known from magnetostatics, a permeable material will be drawn into an area with diverging (or converging) lines of flux. Accordingly, upon activation of the electromagnet, the movable plate will be drawn up and off of the electrical contacts 226 and 224 and towards the electromagnet.

A permanent magnet may be the source of flux. That is, lines of flux will be emitted from the north end of the permanent magnet and return in the far field to the southern end. Such an orientation may have a larger field gradient and thus by more effective in producing the flux gradient for interacting with the permeable material 222, 220. The source of flux, here a permanent magnet 250 may be oriented such that the field lines exit the north pole closest to the switch wafer 2000 and reenter the south pole further away from the switch wafer 2000. It should be understood that this orientation is arbitrary, and the source may also be oriented with its south pole closest to the switch wafer 2000. The permanent magnet may be, for example, a cobalt alloy such as iron-chromium-cobalt, or an AlNiCo, CoPtCr, ceramic or rare earth magnetic material.

Figure 5:
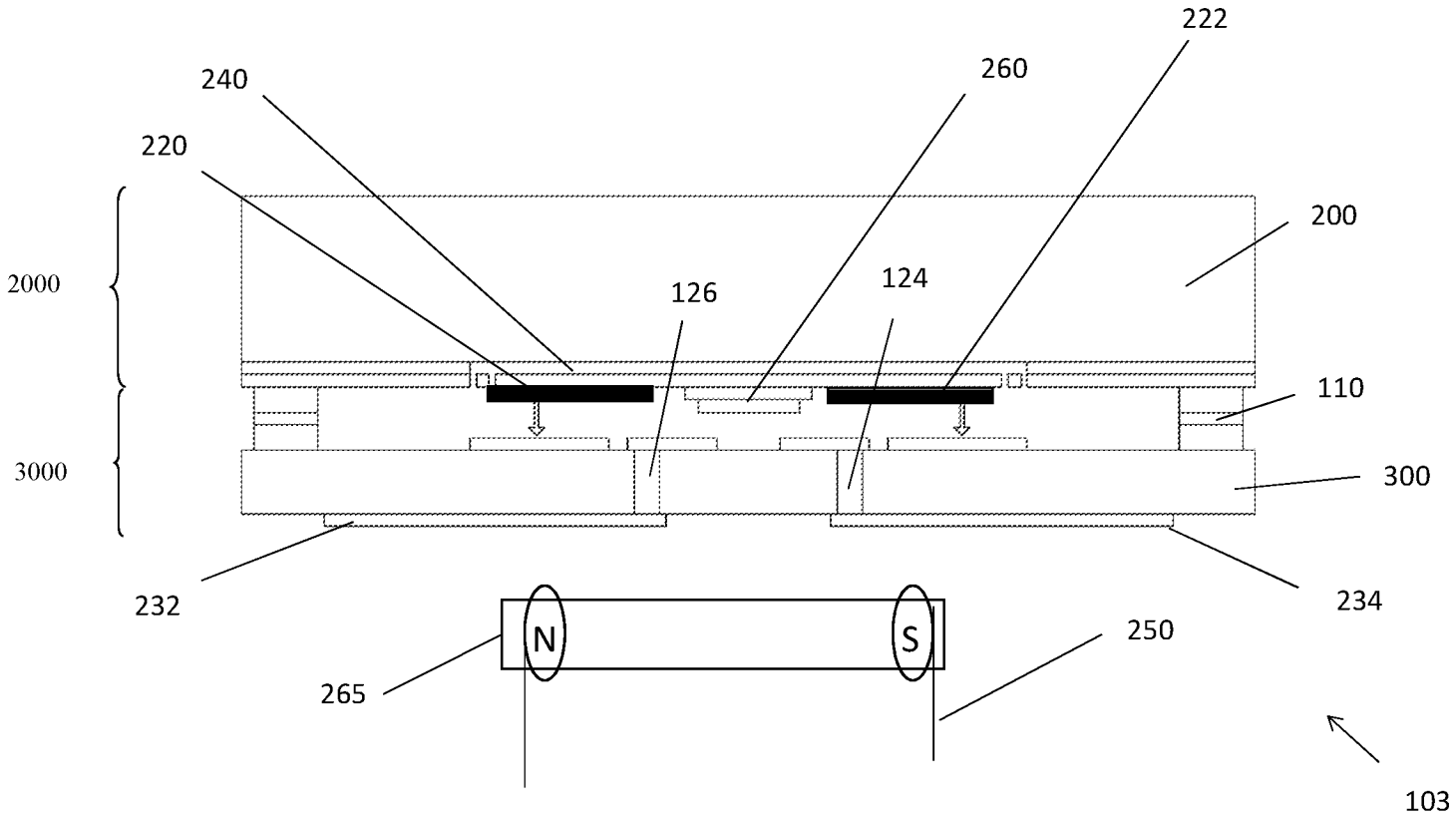
FIG. 5 is a cross sectional view of another embodiment of the dual substrate magnetically actuated MEMS device in a normally open configuration.

Another embodiment of the magnetic MEMS switch is shown conceptually in FIG. 5. In this case again, the movable plate may have a magnetically permeable material 220 and 222, inlaid into, or deposited on, the movable plate structure 240.

The movable suspended plate 240 may be disposed above the fixed adjacent contact electrodes 226 and 224. These contact electrodes may be in electrical communication with two through substrate vias (TSVs) 126 and 124. There may be conducting bonding pads 232 and 234 on the exterior of the switch, for electrical attachment to other devices and equipment.

As before, a first substrate 200 on which the movable plate 240 with at least one electrical shunt bar 260 is formed. A pair of fixed contact 226 and 224 is disposed on the second substrate 300.

As before, a first substrate 200 supports the movable plate 240 with at least one electrical shunt bar 260. A permeable material 220, 222 is deposited adjacent the shunt bar. A pair of fixed contacts 226 and 224 is disposed on the second substrate 300. After forming these structures, the two substrates are bonded together to form the switch.

Here again, reference number 200 refers to the substrate material used to create the movable plate structure 2000. The completed movable plate structure along with supporting features such as metallization pads, deposited and patterned materials, etc. is referred to as plate substrate or plate structure 2000. Similarly, reference number 300 refers to the substrate material used to create the via structure 3000. The completed via structure along with supporting features such as metallization pads, deposited and patterned materials, etc. is referred to as via substrate or via structure 3000. After forming these structures, the two substrates 2000 and 3000 are bonded together to form the switch.

In the quiescent state, the movable plate may be held above the contacts 226 and 224, by a restoring spring, when the magnetic flux is not present. As such, no conductive path exists between contacts 226 and 224. In other words, in the quiescent state, the switch is open. Accordingly, this is a normally open switch. The switch may be closed by positioning a source of magnetic flux below the switch 103 as shown.

A source of magnetic flux may be disposed below the second substrate 3000. The flux will have a gradient associated with it. As is well known from magnetostatics, a permeable material will be drawn into an area with diverging (or converging) lines of flux. Accordingly, upon activation of the electromagnet, the movable plate will be pulled down to the electrical contacts 226 and 224 and towards the electromagnet, thereby closing the switch.

Accordingly, a normally open switch rather than a normally closed switch may be made by placing the source of flux 250 on the other side pf the switch wafer 2000, and adjusting the parameters, dimensions and placements accordingly.

As before, either a permanent magnet or an electromagnet may be the source of flux. If an electromagnet, the magnet may be activated by applying a current to a solenoidal coil 250 wrapped around a permeably magnetic core 265. Like the other embodiments, the source of magnetic flux may be oriented vertically or horizontally. If oriented vertically, the source of flux may have either its north pole or its south pole closest to the switch.

The discussion now turns to methods for fabrication of magnetic MEMS switches shown in FIGS. 2-5.

Fabrication

The dual substrate magnetic MEMS device may be fabricated as follows, and the structure is shown in detail in FIG. 6. Beginning with the plate substrate 2000, an insulating layer of dielectric material 1020, such as $SiO_2$ may be grown or deposited on the silicon surfaces. Alternatively, the $SiO_2$ layer may exist as the insulating layer 1020 on a silicon-on-insulator (SOI) substrate 2000. The dielectric layer 1020 may then be etched away beneath and around the movable plate 240, using a hydrofluoric acid liquid etchant, for example. The liquid etch may remove the silicon dioxide dielectric layer 1020 in all areas where the movable plate 240 is to be formed. The liquid etch may be timed, to avoid etching areas that are required to affix the spring beams of the movable plate 240, which will be formed later, to the handle layer 1030. Additional details as to the dry and liquid etching procedure used in this method may be found in U.S. patent application Ser. No. 11/359,558, filed Feb. 23, 2006, now U.S. Pat. No. 7,785,913 issued Aug. 13, 2010 and incorporated by reference in its entirety.

The next step in the exemplary method is the formation of the dielectric pad 1150 as depicted in FIG. 4. Pad structure 1150 forms an electrical isolation barrier between the shunt bar 260 and the movable plate 240, and other standoffs may form a dielectric barrier preventing the corners of the movable plate 240 from touching high elevation points on the via substrate 3000. The applied magnetic force may draw the movable plate 240 towards the electrical contacts 222 and 224, closing the contacts and closing the switch.

The dielectric structure 1150 may be silicon dioxide, which may be sputter-deposited over the surface of the device layer 1010 of the SOI plate substrate 2000. The silicon dioxide layer may be deposited to a depth of, for example, about 300 nm. The 300 nm layer of silicon dioxide may then be covered with photoresist which is then patterned. The silicon dioxide layer is then etched to form insulating structure 1150. The photoresist is then removed from the surface of the device layer 1010 of the SOI plate substrate 2000. Because the photoresist patterning techniques are well known in the art, they are not explicitly depicted or described in further detail.

In the next step, a conductive material is deposited and patterned to form the shunt bar 260 and a portion of what may form the hermetic seal. If the seal is to be hermetic, the seal may include a metal alloy formed from melting a first metal into a second metal, and forming an alloy of the two metals which may block the transmission of gases. In preparation of forming the seal, a perimeter of the first metal material 1400 may be formed around the movable plate 240. The conductive material may actually be a multilayer comprising first a thin layer of chromium (Cr) for adhesion to the silicon and/or silicon dioxide surfaces. The Cr layer may be from about 5 nm to about 20 nm in thickness. The Cr layer may be followed by a thicker layer about 300 nm to about 700 nm of gold (Au), as the conductive metallization layer. Preferably, the Cr layer is about 15 nm thick, and the gold layer is about 600 nm thick. Another thin layer of molybdenum may also be used between the chromium and the gold to prevent diffusion of the chromium into the gold, which might otherwise raise the resistivity of the gold.

Each of the Cr and Au layers may be sputter-deposited using, for example, an ion beam deposition chamber (IBD). The conductive material may be deposited in the region corresponding to the shunt bar 260, and also the regions which will correspond to the bond line 1400 between the plate substrate 2000 and the via substrate 3000 of the dual substrate magnetic MEMS plate switch 100-103. This bond line area 1400 of metallization will form, along with a layer of indium, a seal which will hermetically seal the plate substrate 2000 with the via substrate 3000, as will be described further below.

While a Cr/Au multilayer is disclosed as being usable for the metallization layer of the shunt bar 260, it should be understood that this multilayer is exemplary only, and that any other choice of conductive materials or multilayers having suitable electronic transport properties may be used in place of the Cr/Au multilayer disclosed here. For example, other materials, such as titanium (Ti) may be used as an adhesion layer between the Si and the Au. Other exotic materials, such as ruthenium (Ru) or palladium (Pd) can be deposited on top of the Au to improve the switch contact properties, etc. However, the choice described above may be advantageous in that it can also participate in the sealing of the device through the alloy bond, as will be described more fully below.

The primary permeable features 220 and 222 may be formed by depositing and patterning a seed layer over portions of the substrate 200. A permeable material such as nickel-iron permalloy, may then be plated onto the patterned areas. For the embodiments described below (FIGS. 7 and 8) having secondary flux guides, cavities may be etched into the substrate, a seed layer deposited conformally, and nickel iron then plated into the cavities. The plated substrate may then be planarized to remove any area proud of the remaining surface.

To form the movable plate 240 and restoring springs, the surface of the device layer 1010 of the SOI plate substrate 2000 is covered with photoresist which is patterned with the design of the movable plate and springs. The movable plate outline is the etched into the surface of the device layer by, for example, deep reactive ion etching (DRIE). Since the underlying dielectric layer 1020 has already been etched away, there are no stiction issues arising from the liquid etchant, and the movable plate is free to move upon its formation by DRIE. As before, since the photoresist deposition and patterning techniques are well known, they are not further described here.

Figure 6:
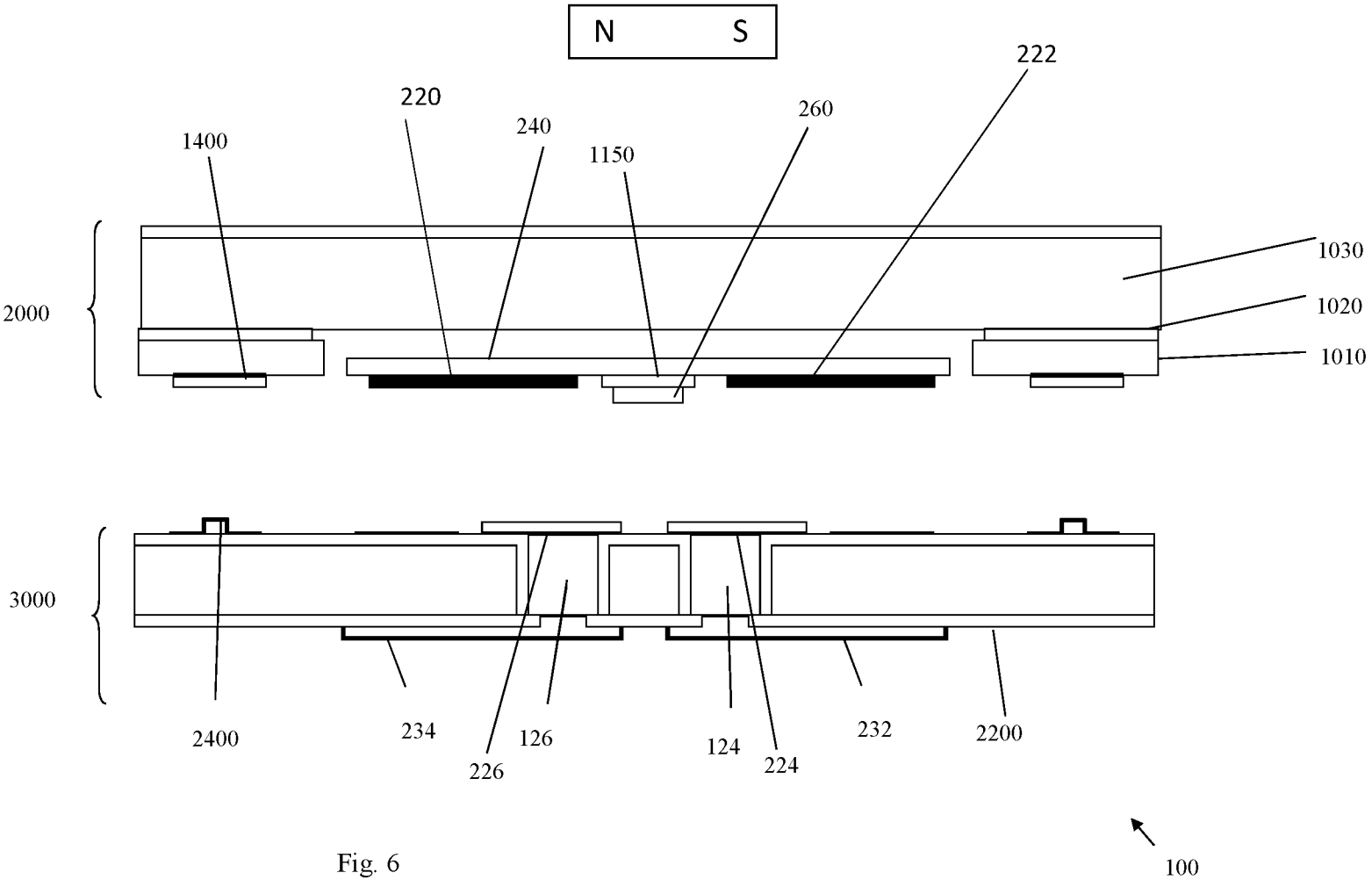
FIG. 6 shows a more detailed cross sectional view of the dual substrate magnetically actuated MEMS device with supporting structures.
Figure 7:
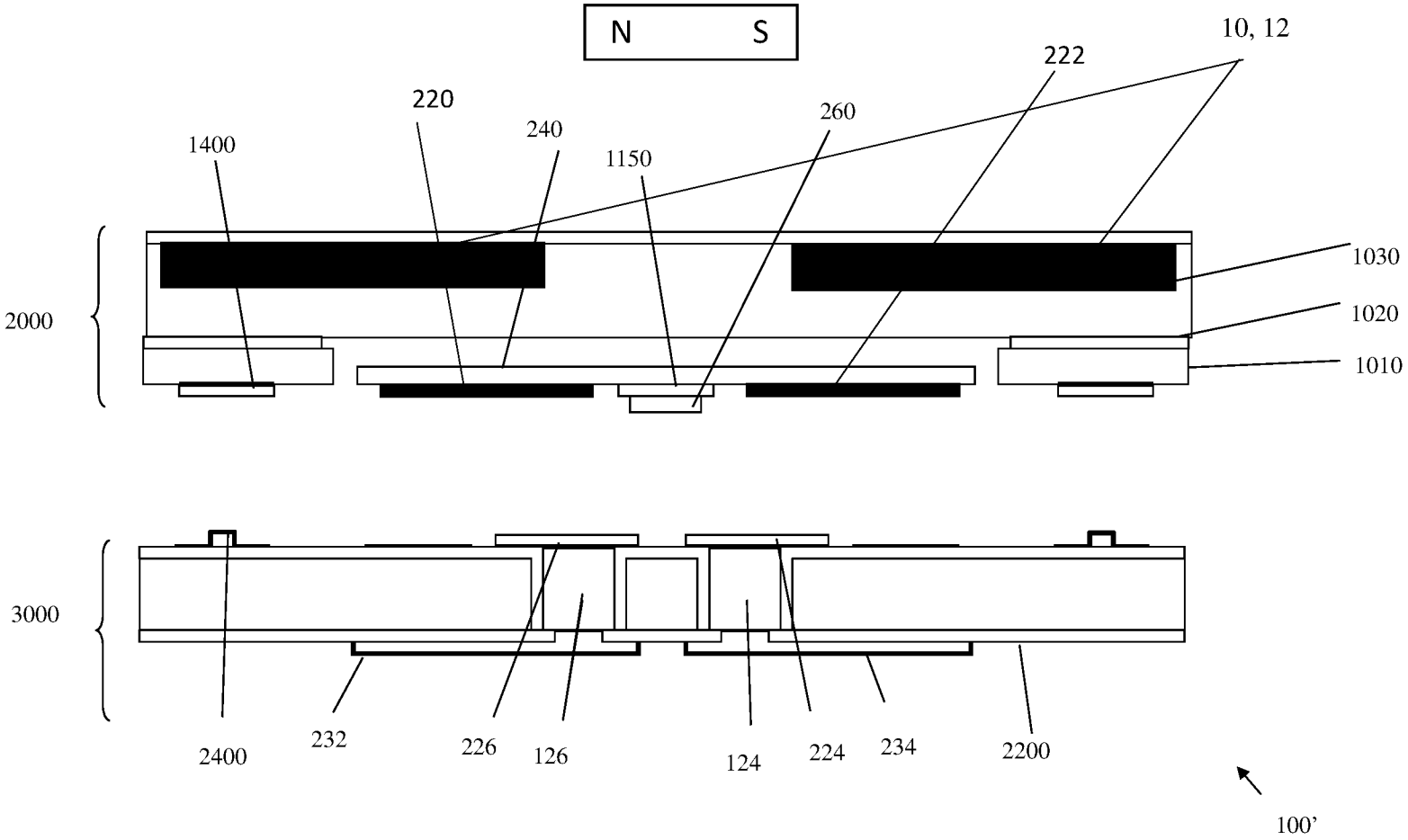
FIG. 7 shows another embodiment of the dual substrate magnetically actuated MEMS device using large secondary flux guide structures in a normally closed configuration.
Figure 8:
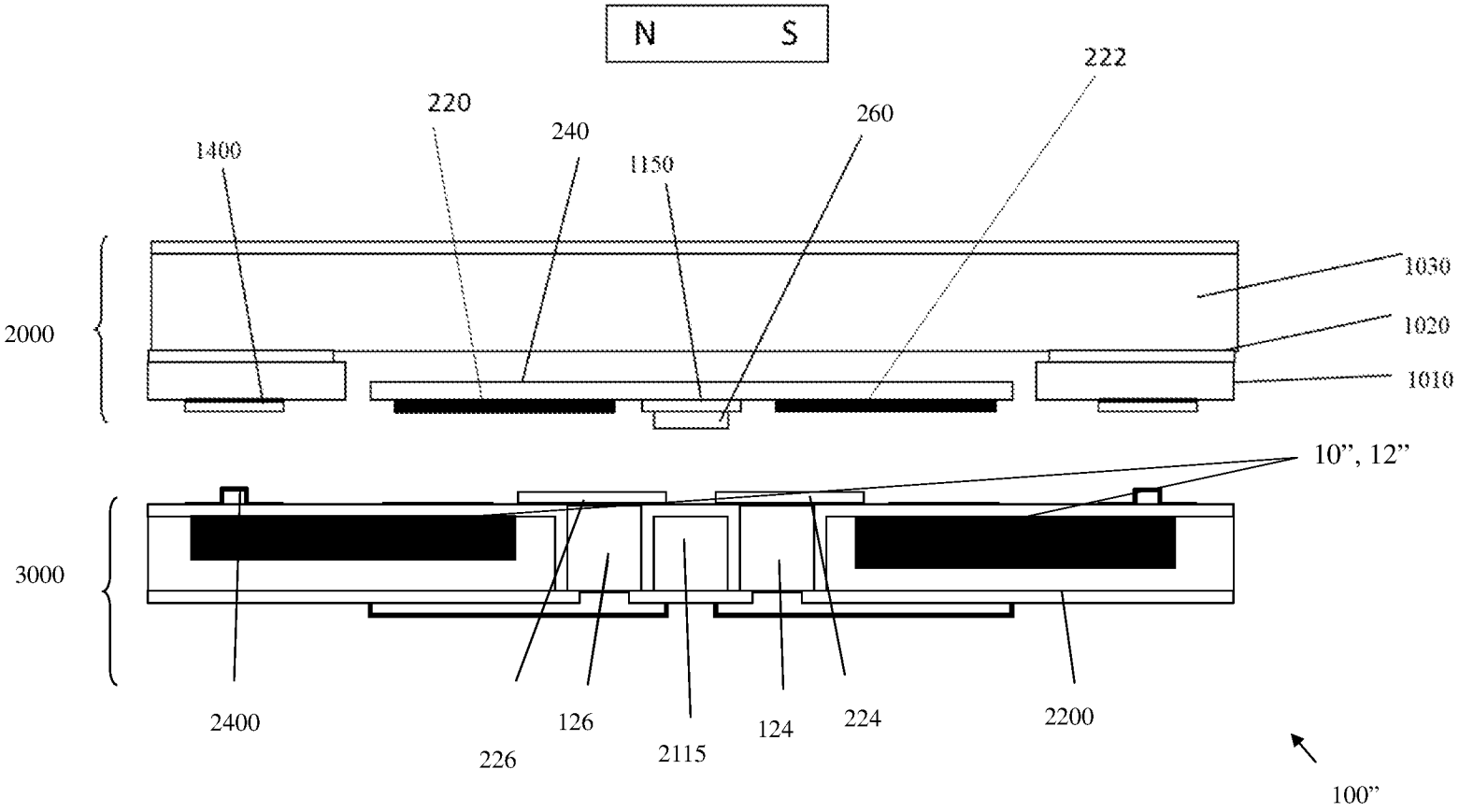
FIG. 8 shows another embodiment of the dual substrate magnetically actuated MEMS device using large secondary flux guide structures in a normally open configuration.

Turning now to the via substrate 3000, another metallization region may be deposited over the substrate 3000, as shown in FIGS. 6 and 7. This metallization layer may form the bond ring 2400. In one exemplary embodiment, the metallization layer may actually be a multilayer of Cr/Au, the same multilayer as was used for the metallization layer 1400 on the plate substrate 2000 of the dual substrate magnetic MEMS plate switch 100. The metallization multilayer may have similar thicknesses and may be deposited using a similar process as that used to deposit metallization layer 1400 on substrate 2000. The metallization layer may also serve as a seed layer for the deposition of a metal solder bonding material, as described in the incorporated '798 patent. Layer 2200 may be a native insulating layer of $SiO_2$ that forms around the silicon substrate 3000. Two more external (to the switch) electrical pads 232 and 234 may be connected to through substrate vias 126 and 124 within the device 100.

Each of the Cr and Au layers may be sputter-deposited using, for example, an ion beam deposition chamber (IBD). The conductive material may be deposited in the region corresponding to the contacts 226 and 224, and also the regions which will correspond to the bond line 2400 between the plate substrate 2000 and the via substrate 3000 of the dual substrate magnetic MEMS plate switch 100. This bond line area 1400 and 2400 of metallization may form, along with a layer of indium, a seal which will hermetically seal the plate substrate 2000 with the via substrate 3000. Alternatively, a thermocompression bonding technique may make use of two gold layers 1400 and 2400.

Finally, to form the switch, SOI plate substrate 2000 is pressed against the via substrate 3000 and the substrates are bonded together in a wafer bonding chamber for example. The adhesive may be the previously mentioned thermocompression bond, metal alloy bond, or a glass frit bond for example. At bonding, the substrate-to-substrate separation may be determined by a standoff 2400 in the bondline, as was shown in FIG. 6.

Exemplary Embodiments with Secondary Fluxguides

FIGS. 7 and 8 shows alternative embodiments of the magnetic MEMS switch, which use additional permeable magnetic features as fluxguides ("secondary fluxguides") to improve the efficiency of the device. The secondary fluxguides may be larger and thicker, and disposed in the body of the substrates rather than near the switch contacts. The secondary fluxguides may serve to deliver more flux to the primary fluxguides, because they operate over larger lateral distances and are thicker. Together, these fluxguides may make an efficient magnetic structure with sufficient force to obtain good contact between the shunt bar 260 and the contacts 224 and 226.

As is well known from magnetostatics, permeable magnetic material can be used to guide, or concentrate, lines of magnetic flux in a particular location in space. Because of the very low reluctance, permeable materials tend to gather magnetic flux lines to themselves, thus concentrating them in a particular location. FIG. 7 shows an embodiment of the magnetostatic switch, which uses additional permeable magnetic features to focus flux in the vicinity of the movable plate 240.

In this embodiment 100' shown in FIG. 7, two permeable features, 10' and 12', may be inlaid or deposited in the substrate 2000. The procedure for forming these features is similar to that described above with respect to the other permeable magnetic materials. The dimensions of these features, 10, maybe on the order of 10 to 2000 microns in length and at least 10 μm in thickness. Once again, the purpose of these permeable features 10', 12' is to concentrate the lines of flux emanating from the magnet disposed above the substrate 2000 or below substrate 3000, as shown in FIG. 7, in the vicinity of the primary permeable features to 222 and 220, which are disposed on the movable plate 240.

When a source of magnetic flux 250 is active, such as a permanent magnet, or an electromagnet is energized, flux emanating from the poles of the source 250 are gathered by the permeable features 10, in the vicinity of the movable plate 240. The presence of the fluxguides thus tends to draw the movable plate 240 towards the permeable features 10', 12', and magnet 250. If the shunt bar 240 is disposed against the contacts to 222 and 224, raising of this shunt bar would result in the opening of the contacts, that is, the opening of the switch shown in FIG. 7.

FIG. 8 shows another embodiment of the magnetic MEMS switch 100". In FIG. 8, the additional secondary flux guides, 10", 12" a permeable magnetic material is again inlaid or deposited on the via substrate 3000. This magnetic material 10", 12" may be formed in the same way as magnetic material 10 from FIG. 7. The presence of these permeable features 10", 12" is to draw and concentrate lines of flux emanating from a magnetic source, to the vicinity of the movable plate 240. Accordingly, in the quiescent position, the movable plate 240 is suspended above the electrical contacts 224 and 226. Upon activating the source of flux, or positioning it near the MEMS switch, with this magnetic flux source 250 disposed below this via substrate 3000, is to lower the shunt bar across the two electrical contacts, thus closing the switch.

Fabrication

FIGS. 9-14, described below, outline a fabrication procedure which may be used to make the magnetic dual substrate MEMS switch, which operates as a normally closed switch. Accordingly FIGS. 9-14 describe a fabrication method for forming the switch shown in FIG. 7.

Figures 9, 10:
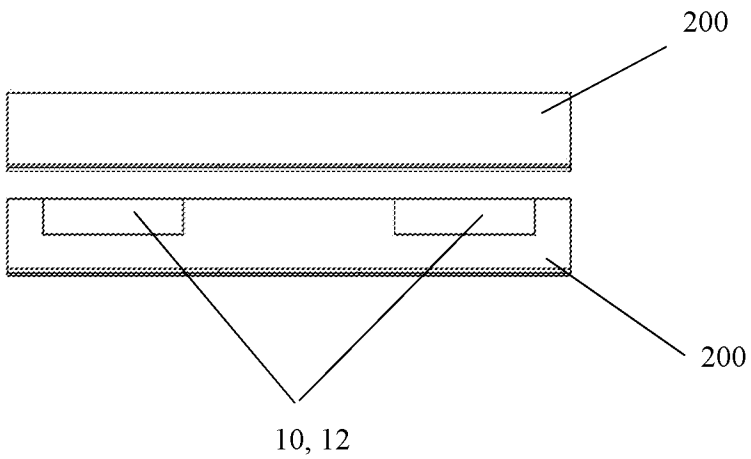
FIGS. 9-14 is describe a process which may be used to fabricate the device shown in FIG. 7, the normally closed switch.

The first step may begin in FIG. 9 with the substrate 200. Substrate 200 may be a silicon-on-insulator (SOI) substrate, which includes a thick handle layer, a thinner dielectric layer, and another thin device layer of silicon. Such composite substrates are well known in the art. Beginning with the substrate 200 shown in FIG. 9, the starting SOI substrate is shown.

Figures 11, 12:
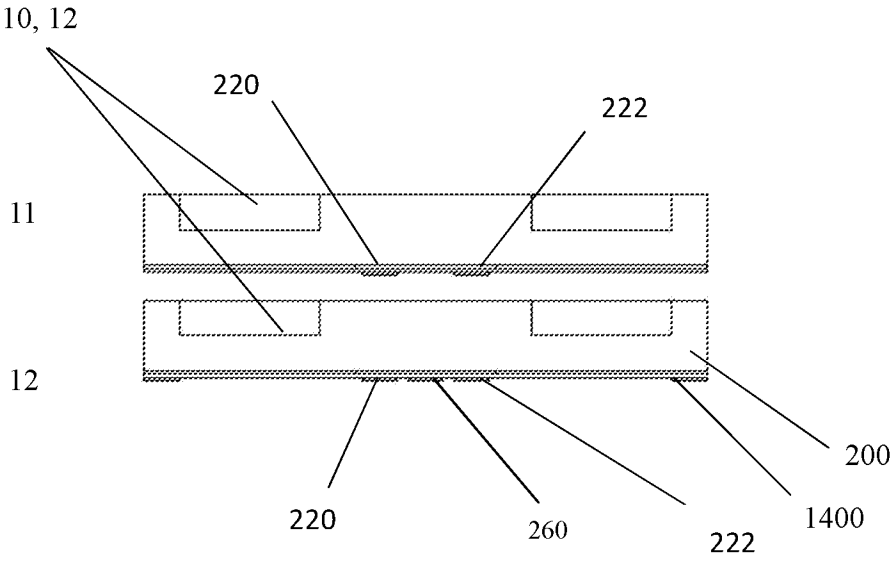

In FIG. 10, on the upper surface of substrate 200, the cavities that will accommodate the permeable magnetic materials 10, 12 are formed, adjacent to the region that will become the movable plate 240. The permeable material may be electroplated using a seed layer, for example, as is known in the art. In FIG. 11. The primary permeable features 220 and 222 are deposited on the movable plate 240. As shown in FIG. 12, the shunt bar 260 is formed, along with the metal bondline, which as described above, may use a similar material. A dielectric material 1150 which will isolate the shunt bar from the remainder of conductive material of substrate 2000 may also be deposited.

Figures 13, 14:
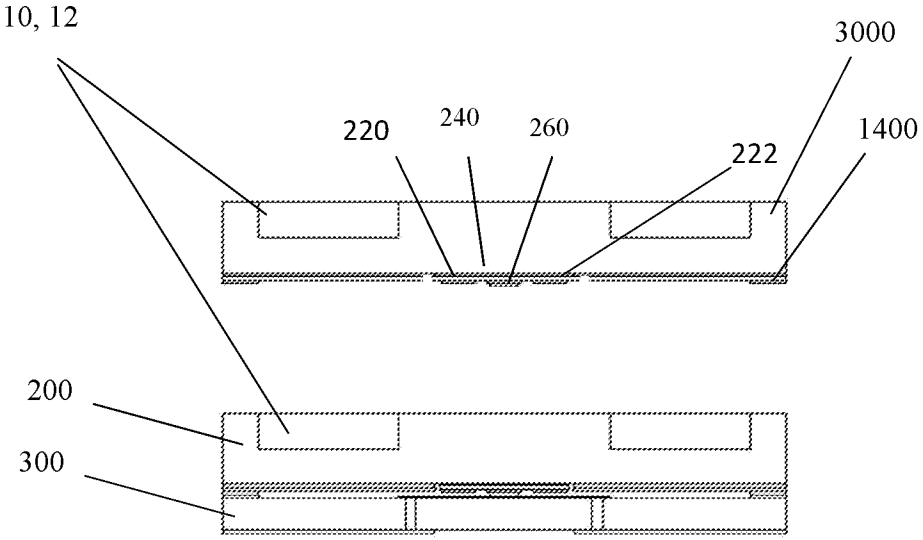

In FIG. 13, the outline of the movable plate 240 is formed in the device layer of the substrate 2000. The movable plate 240 may be formed by deep reactive ion etching the device layer of The SOI substrate. In FIG. 14, the switch wafer 2000 which was just fabricated 200 is bonded to a via wafer 3000 using the bonding process described above, for example. That is, the two substrates may be bonded together using, for example, a metal alloy or thermocompression bond.

Figure 15:
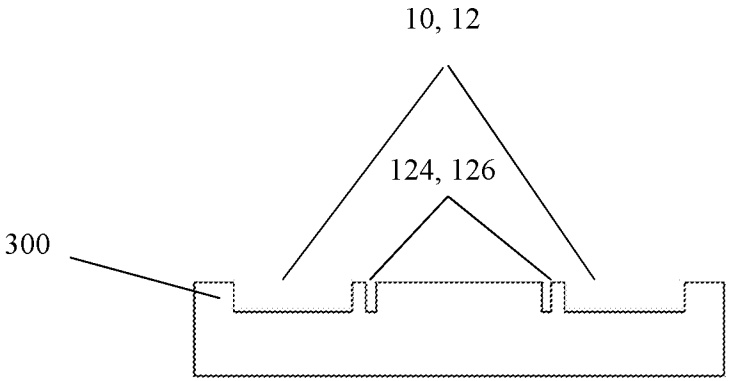
FIGS. 15-22 is describe a process which may be used to fabricate the device shown in FIG. 8, a normally open switch.
Figure 16:
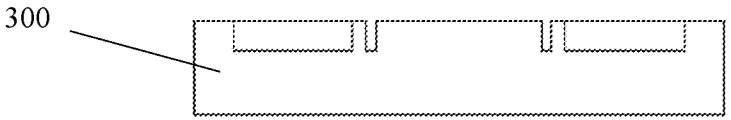

We now turn to the normally open embodiments shown in FIG. 8, and describe below a fabrication procedure for forming this structure. This procedure is illustrated by FIGS. 15-22, and described below. In FIG. 15, a bare silicon substrate 300 maybe photolithographically patterned with features that will form the permeable magnetic material 10, 12, as well as the through substrate vias 15. These features may be formed by deep reactive ion etching into the body of the substrate in FIG. 15. Aa SiO2 layer is then generally thermally grown over the entirety of the substrate 300. In Fig. and 16, the permeable magnetic material is electroplated into the voids 10, 12 formed in the silicon substrate in FIG. 15. This material may be electroplated in a seed layer, and perhaps using a conformally deposited and patterned seed layer. The top surface of substrate 300 may then be planarized using, for example, chemical mechanical polishing. The situation is as shown in FIG. 16.

Figures 17, 18:
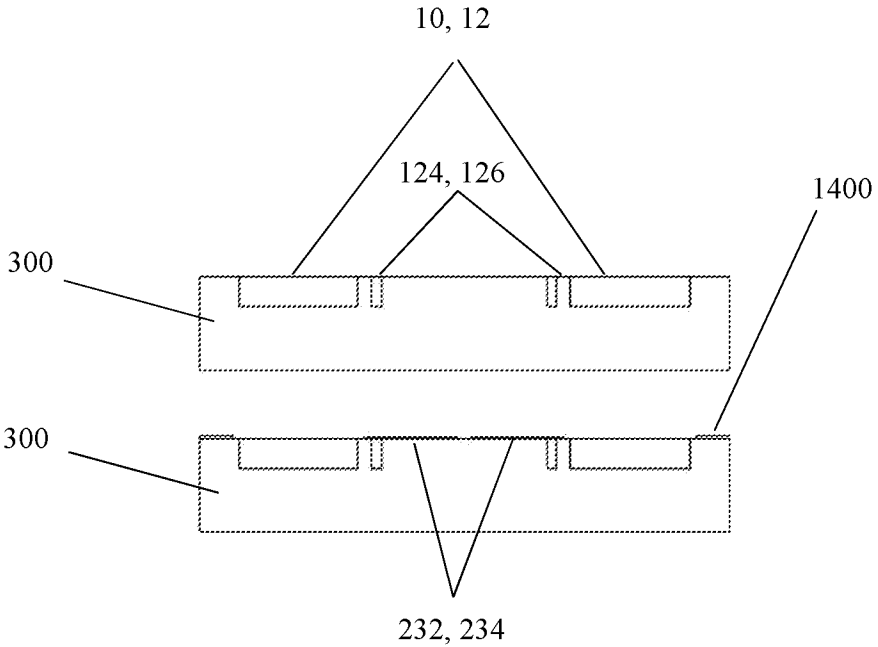

The through substrate vias 124, 126 may also be electroplated with a conductive material such as copper or gold shown in FIG. 17. The top surface may once again be abraded or polished.

In FIG. 18, a conductive material 35 may be deposited and patterned, which will form the contacts 232 and 234 and the bond line, 1400. This material may be, for example, gold, copper, or aluminum.

Figures 19, 20:
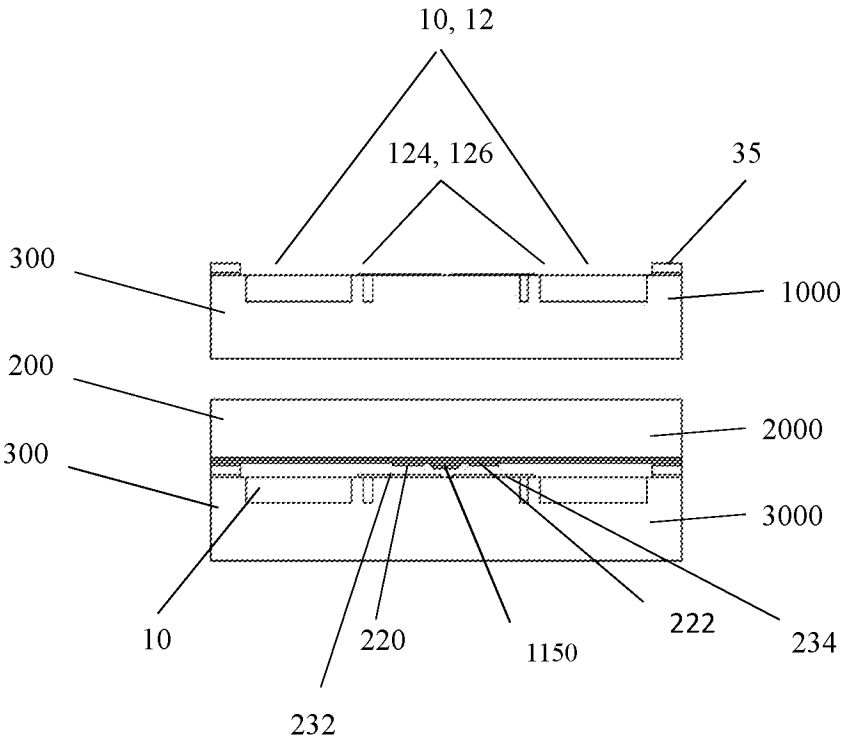

In FIG. 19, a conductive spacer 35 may be deposited over the bondline feature 1400 which was formed in the previous step. The spacer may determine the separation between the two substrates which will be bonded in the subsequent steps.

The bonding step is shown in FIG. 20. In this bonding step, a switch wafer 2000 is bonded to the via wafer 3000 which was formed with the permeable features 10, 12, as described above. The bonding procedure may be similar, or identical, to that described above with respect to the preceding dual substrate magnetic MEMS switch illustrations.

Figures 21, 22:
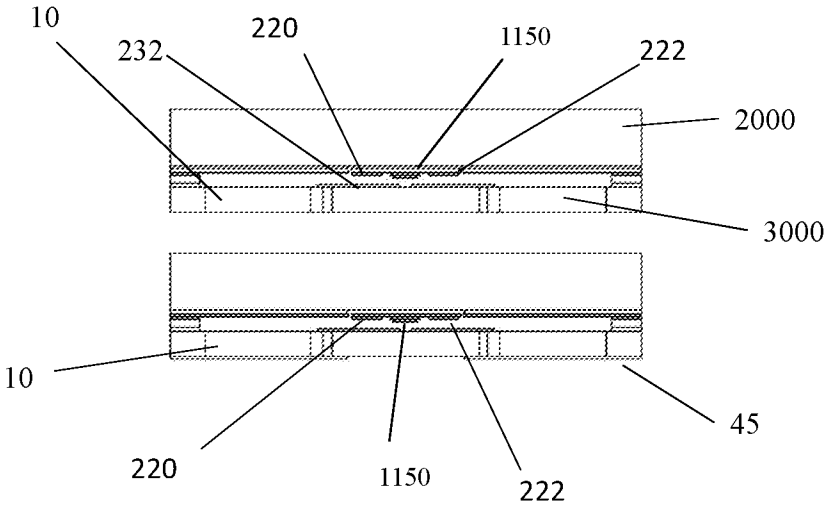

In FIG. 21, the obverse side of the via wafer 3000 may be ground down to reveal the through substrate vias 132, 134 formed previously. The grinding may remove all of the silicon material from the blind holes which were formed earlier, rendering these features continuous through the substrate material.

In FIG. 22 The external contact metallurgy 45 is deposited on the outside of the switch. This metallurgy may form the bonding pads which will be used to attach electrical leads. These pads may couple the MEMS magnetic dual substrate switch to, for example, to a printed circuit board. The bonding pad and these metallic features are shown as 45 in FIG. 22.

Some exemplary dimensions are as follows: The primary permeable feature may be about 0.1-2.0 microns thick, 10-50 microns wide. The secondary permeable features may be about 10-50 microns thick and 50-300 microns wide. Other exemplary dimensions for other structures may be found in the incorporated '691 and '798 patents.

The structure described above uses thin films of magnetically permeable material to form the primary and secondary flus guides. These thin files have a generally rectangular shape with uniform cross section alone the axes of the feature. The shape is as shown in FIG. 23.

In the improvement disclosed here, the plan view shapes of the primary flux guides on the movable plate are referred to as 220 and 222. Although two reference numbers are used, it should be understood that 220 and 222 may be contiguous portions of the same permeable thin films. Two reference numbers were used in the description above because there appear to be two permeable features on either side of the shunt bar, when the structure us shown in cross section. However in some embodiments, there may be just a single thin film of permeable material *the "primary" flux guides) substantially surrounding the shunt bar. Furthermore, in some embodiments the single film of permeable material can act as the shunt bar. Similarly, the secondary flux guides can act as the two electrical contacts, against which the shunt bar is disposed when the switch is closed. The larger, secondary flux guides are designed to increase the flux density in the region of the switch. The details of the shape of the optimized secondary flux guides are discussed below. Reference number 220" may be used going forward to refer to this singular, contiguous primary fluxguide which may be disposed on the movable plate 240.

Figure 23:
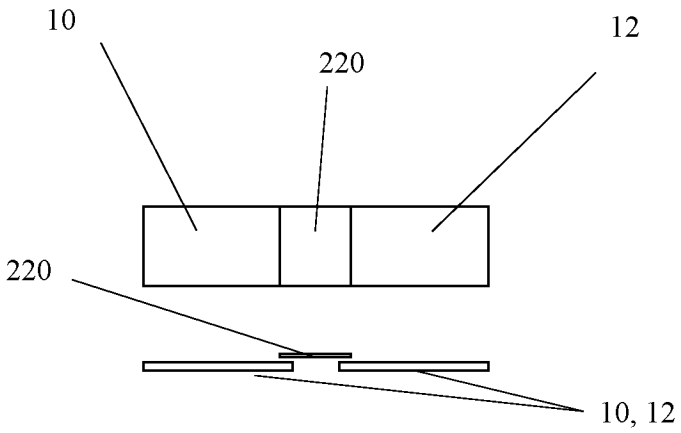
FIG. 23 shows another embodiment of the dual substrate magnetically actuated MEMS device having optimized flus guides.

FIG. 23 shows a previous embodiment of the dual substrate magnetically actuated MEMS device having secondary rectangular flux guides 10 and 12. The shapes of these secondary flu guides 10 and 12 have been designed for simplicity of fabrication without attending to magnetic effects.

In fact, the embodiment shown in FIG. 23 may have significant demagnetizations effects. Demagnetizing fields may be caused by the poles accumulating on the edges of the magnetic material. Pole accumulation can all occur at edges within the magnetic circuit. This can best be visualized by considering the embodiment shown in FIG. 23, where the slabs are rectangular ones. Note that the inner edges of the thick bottom slabs and the N and S edges of the shunt bar provide significantly more demagnetization field, resulting in actuation force of −½ that of the elliptical structures of similar lateral dimension.

By careful attention to the shapes and contours, the effect of these regions can me muted or mitigated. In other words, performance can be improved by designing these features to have a contoured, non-uniform cross section to reduce the accumulation of poles along the edges. The contoured shape may allow flux travelling within the permeable material to be concentrated in areas near the shunt bar of the switch. In particular, the demagnetizing effects may be reduced by (1) applying a novel elliptical shape to all permeable slabs and (2) reducing the areas internal to the switch where magnetic poles can congregate. The remainder of this disclosure describes these surprising details.

To optimize the flux conductance we have used thick permeable layers to increase the cross-section of the device to the external field, and we then shrink the cross-section of the internal permeable slabs to concentrate the flux into regions where high flux density is needed, namely in the gap between the contacts.

To address the architectural and reliability requirements that the contacts remain accessible throughout the process, we employ the dual substrate approach that has been patented by IMT.

To address the fatigue and creep issues of a microcrystalline beam structure, we form the springs 224" and support structure for the moving permeable slab in the mono-crystalline Si device layer of an SOI wafer 2000. The volume of permeable metal embedded in the moving Si mount is minimized to reduce strain and warpage effects. The two electrical contacts may be formed in the second via substrate 3000.

Figure 24:
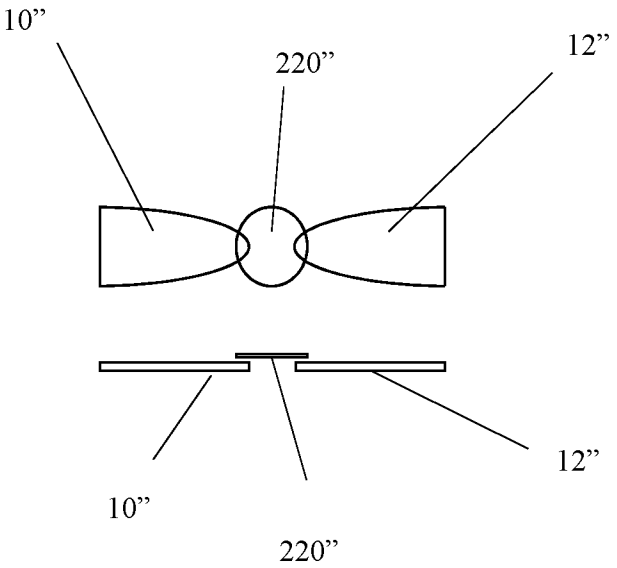
FIG. 24 shows a prior art flux guide without optimization of the plan view shape.

FIG. 24 shows a novel design using permeable features with non-uniform cross sections. In this embodiments, the flux guides 220", 10" and 12" may have an optimized shape. The shapes of the secondary flux guides 10" an 12" have been designed to concentrate the flux in the area of the shunt bar and primary flux guide 220"

In some embodiments, the permeable magnetic feature may have a non-uniform cross section, wherein the cross section is smaller in areas near the shunt bar and contacts. The term "non-uniform cross section" should be understood to mean that this magnetic structure may have a smoothly varying contour as seen in the plan view, that is, when the fabrication surface is viewed from above. When this contoured plan view shape is viewed in cross section, the cross section is non-uniform. In some embodiments, the permeable feature may have an elliptical shape, which guides and concentrates the lines of magnetic flux in the vicinity of the shunt bar and contacts. This may improve or increase the contact force applied between the shunt bar and the contacts, thus reducing the contact resistance and improving the reliability of the switch. In one embodiment, the major and minor axes of the ellipse are between about 50-3000 microns and between about 10 and 300 microns respectively. It should be understood that the permeable feature may be shaped as only a section an ellipse, as shown in FIG. 24, but the section of the ellipse can be fully characterized by the magnitude of its major and minor axes. For example, in one embodiment, the portion of the permeable material with non-uniform cross section may include a shape of one-half of an ellipse, when viewed in plan view.

As discussed in detail above, these permeable features may be formed lithographically in s silicon or SOI substrate, in the fabrication surface using photoresist and lithographic masking, as is well known in the art. As such, features with arbitrarily complex shapes may be formed in this surface. Curved or contoured shapes such as circles and ellipses are readily formed in this way. For the normally open (NO) switch configuration, they may be formed in the via substrate 3000, They may optionally be formed on the plate substrate 2000, as was illustrated in FIG. 7, for a normally closed switch.

A cross sectional and plan view drawing of the magnetic features (flux guides) in one embodiment of the magnetic MEMS switch are shown in FIG. 24. The secondary flux guides 10" and 12" may have a shape of a half-ellipse. The half-ellipse shapes on the left and right are relatively thick (50 um) slabs of NiFe of 81/19 alloy. Modelling shows that the increased saturation of the 45/55 alloy does nothing to overcome the demagnetization fields, which occur due to pole accumulation at the straight edges of the half-ellipses. It is the demagnetization fields that prevent the magnetic layers from reaching saturation. The shunt bar is the small ellipse 220" in the center. It will be inlaid into the device layer (10 um in thickness) of an SOI wafer.

Surprisingly, better performance is realized if the overlap area between each of the thick half-ellipses and the shunt bar is held to a minimum. This can be understood as follows. The force between two parallel magnetic surfaces is (in SI units)

$$F = \frac{B^2 A}{2\mu_0}$$

Where B(Tesla) is the flux density, A(meter^2) is the area of the contact surface and $m_o$ (=1.25e-6 Newton/Ampere$^2$) is the permeability of free space. Although this formula suggests at first glance that the force increases with contact area, this is not the case. Given that the flux density is the flux per unit area, the equation above can be rewritten as $$F = \frac{\Phi^2}{2A\mu_O}$$

where Φ=BA. Thus, the goal in design to maximize the flux (Φ) and minimize the area. The half-ellipses are an ideal way to maximize the capture cross-section. This then determines the available flux. The overlap is then minimized such that the effective area of the fringing field in the gap is a small fraction of the total area. Although this formula implies that the force is independent of the gap, the case where Φ=Φ (gap) does indeed occur where two zero-remanence, highly permeable slabs interact. This arises because the reluctance of the circuit is a function of the gap.

Figure 25:
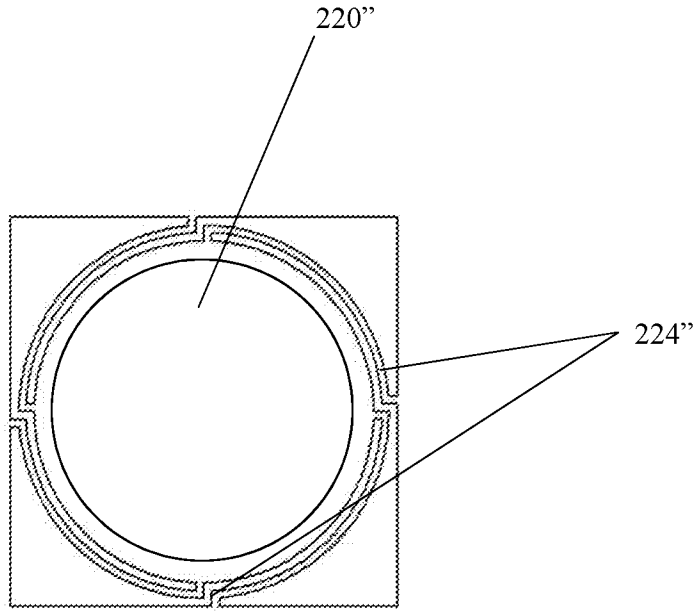
FIG. 25 shows a plan view of the optimized dual substrate magnetically actuated MEMS device using contoured flux guides that focus the flux in the region of the shunt bar.

FIG. 25 shows a plan view of the optimized dual substrate magnetically actuated MEMS device using contoured flux guides that focus the flux in the region of the shunt bar. The support structure for the top slab, also referred to as the shunt bar 220", is shown in FIG. 25. The control permeable magnetic portion 220" may have an elliptical shape defined by an inlay of 81/19 NiFe within the 10 um thick device layer of san SOI wafer. Four quarter-round springs 224" may be etched into this device layer to provide a stable gap in the absence of an external magnetic field. Nominally these springs are 10 um in width×10 um in thickness×300 um in length. The 4 springs acting together have a net spring constant on the order of 80-120 N/m. The advantages of the single crystal silicon material for these springs is as discussed elsewhere.

Figure 26:
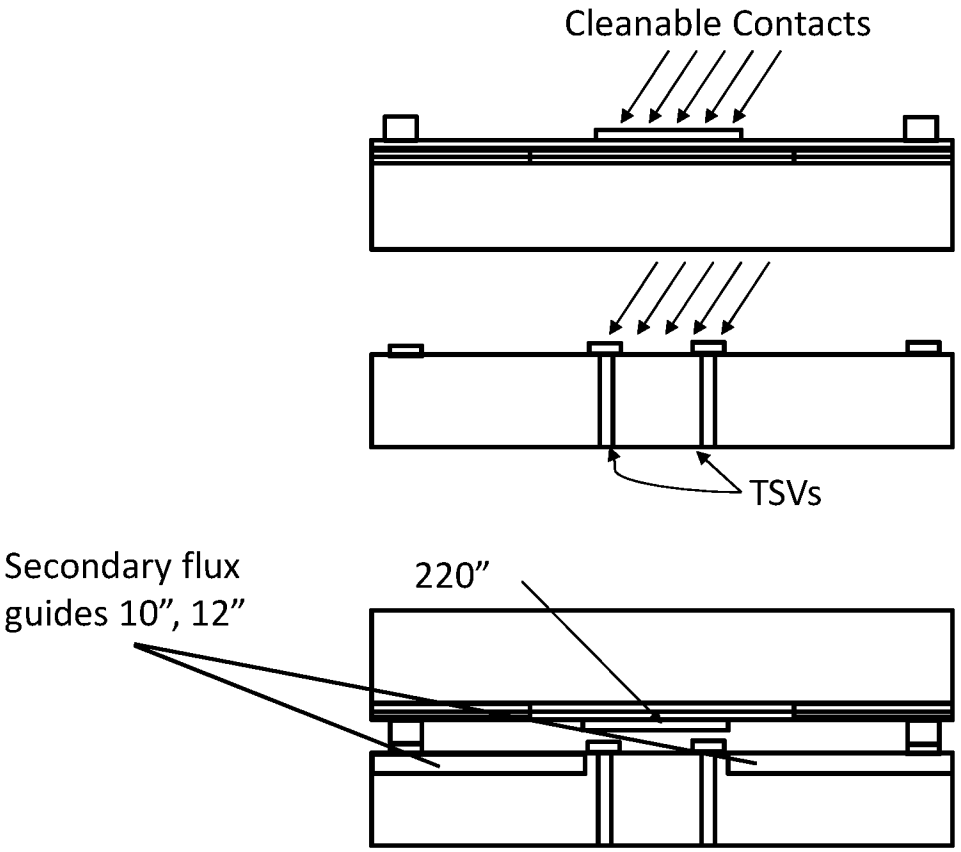
FIG. 26 shows the dual substrate magnetically actuated MEMS device; upon bonding of the two substrates together to form the switch.

Finally, the dual substrate architecture is shown in FIG. 26, where the thick half-ellipses 10" and 12" are fabricated on one substrate and the thin shunt bar ellipse 220" is fabricated on a second substrate, into which the springs are also etched. RuO2 may then be deposited and patterned on both substrates for reliability enhancement purposes. Finally, the two substrates are bonded together to form the switch. The basic process flow was described by FIGS. 9-22 and discussed above with respect to those figures.

Accordingly, FIG. 26 shows a cross section of the optimized dual substrate magnetically actuated MEMS device; upon bonding of the two substrates together to form the switch. As shown in FIG. 26 and described above, the electrical contacts are exposed until the very end of the process, allowing them to be cleaned a final time. They may also be coated with RuO2 which is a material having excellent wear characteristics. This material is described more fully in U.S. patent application Ser. No. 15/355,608 filed Nov. 18, 2016, incorporated by reference in its entirety.

A method for manufacturing an magnetic MEMS switch is disclosed. The method may include forming at least two electrical contacts on a second substrate, forming a movable plate on a first substrate, wherein the movable plate is coupled to the first substrate by a plurality of restoring springs, and forming a conductive shunt bar on the movable plate, wherein the shunt bar is dimensioned to span the two electrical contacts. The method may further include forming a permeable magnetic feature on at least one of the first and the second substrates, wherein the permeable magnetic feature has a non-uniform cross section, and coupling the first substrate to the second substrate with an adhesive bond to form the magnetic MEMS switch.

The magnetic material may be at least one of a permanent magnetic material and a permeable magnetic material. The permanent magnetic material may comprise a cobalt alloy and the permeable magnetic material comprises a NiFe alloy. The method may further include forming electrical vias through a thickness of the second substrate, wherein forming the electrical vias comprises forming at least one blind hole on a front side of the second substrate, forming a seed layer in the at least one blind hole, depositing a conductive material onto the seed layer, and removing material from a rear side of the second substrate to remove a dead-end wall of the at least one blind hole.

Depositing a conductive material onto the seed layer may comprise plating copper onto the seed layer, and coupling the first substrate to the second substrate with a hermetic seal may comprise depositing a first metal on the first substrate, depositing a second metal on the second substrate, and coupling the first substrate to the second substrate by heating the first substrate and the second substrate to at least a melting point of at least one of the first metal and the second metal.

The first substrate may be a silicon-on-insulator substrate, and the second substrate may be at least one of a silicon wafer, a silicon-on-insulator substrate, and a glass wafer.

Forming the movable plate on the first substrate may include etching an outline of the movable plate in a device layer of the silicon-on-insulator substrate, releasing the movable plate from a handle wafer of the silicon-on-insulator substrate by etching an oxide layer between the device layer and the handle wafer.

A magnetic MEMS switch is also disclosed, and may include a movable plate formed on a first substrate, wherein the movable plate is coupled to the first substrate by a plurality of restoring springs, and wherein the movable plate has a magnetic material inlaid therein, at least one electrical contact formed on a second substrate, and a hermetic seal which couples the first substrate to the second substrate, and seals the MEMS switch, such that the MEMS switch operated by disposing a source of magnetic field gradient in a vicinity of the magnetic MEMS switch, wherein the gradient is sufficient to move the movable plate and open or close the switch.

The permeable features may have a variable cross section that is smaller nearer to the shunt bar, such that flux traveling within the permeable material is concentrated nearer to the shunt bar. The variable cross section may have the shape of an ellipse in the plan view. The first substrate may be a silicon-on-insulator substrate including a device layer, a handle wafer and an insulating oxide layer between the device layer and the handle wafer, and the second substrate is at least one of a silicon substrate, a silicon-on-insulator substrate and a glass substrate. The switch may also include an electromagnet disposed above the first substrate or below the second substrate, and a magnetic plate formed on the second substrate. It may also include a permanent magnet disposed above the first substrate or below the second substrate. The magnetic material may be at least one of a permanent magnetic material and a permeable magnetic material. The permanent magnetic material may be a cobalt alloy or a neodymium-boron alloy and the permeable magnetic material may be a NiFe alloy.

The source of flux may be disposed above the first substrate or below the second substrate, and may comprise at least one of an electromagnet and a permanent magnet. The non uniform cress section may have a smaller cross section nearer to the shunt bar. In some embodiments, the non-uniform cross section may have the shape of an ellipse in the plan view.

The movable plate is formed from the device layer of the silicon-on-insulator substrate, and affixed to the handle wafer of the silicon-on-insulator substrate by the oxide layer. The movable plate further may comprise a shunt bar which electrically connects two electrical contacts formed on the second substrate when the magnetic MEMS switch is closed, wherein the shunt bar is electrically isolated from other portions of the movable plate.

A method of operating the magnetic MEMS switch is also disclosed and may include applying a current to the electromagnet disposed above the movable plate formed on the first substrate, opening an electrical connection between the two electrical contacts by raising the movable plate and shunt bar toward the electromagnet in response to the applied current. The method may further comprise applying an input signal to one of the contacts formed on the second substrate, and obtaining an output signal from the other electrical contact formed on the second substrate.

While various details have been described in conjunction with the exemplary implementations outlined above, various alternatives, modifications, variations, improvements, and/or substantial equivalents, whether known or that are or may be presently unforeseen, may become apparent upon reviewing the foregoing disclosure. For example, while the disclosure describes a number of fabrication steps and exemplary thicknesses for the layers included in the MEMS switch, it should be understood that these details are exemplary only, and that the systems and methods disclosed here may be applied to any number of alternative MEMS or non-MEMS devices. Furthermore, although the embodiment described herein pertains primarily to an electrical switch, it should be understood that various other devices may be used with the systems and methods described herein, including actuators and valves, for example. Accordingly, the exemplary implementations set forth above, are intended to be illustrative, not limiting.

What is claimed is:

1. A magnetic MEMS switch, comprising:

a movable plate formed on a first substrate, wherein the movable plate is coupled to the first substrate by a plurality of restoring springs;

at least two electrical contacts formed on a second substrate;

an electrically conductive shunt bar formed on the movable plate, dimensioned so as to span the two electrical contacts;

at least one permeable magnetic feature inlaid into at least one of the first and the second substrates, wherein the at least one permeable feature has a non-uniform cross section; and a seal which couples the first substrate to the second substrate, and seals the MEMS switch, such that the MEMS switch operated by disposing a source of magnetic field gradient in a vicinity of the magnetic MEMS switch, wherein the gradient is sufficient to move the movable plate and open or close the switch.

2. The magnetic MEMS switch of claim 1, further comprising:

a source of magnetic flux disposed adjacent to the magnetic MEMS switch, wherein the source of magnetic flux is configured to either open or close the two electrical contacts by attracting the permeable magnetic material toward the source of magnetic flux.

3. The magnetic MEMS switch of claim 2, wherein the source of flux is disposed above the first substrate or below the second substrate, and comprises at least one of an electromagnet and a permanent magnet, and wherein the non uniform cress section has a smaller cross section nearer to the shunt bar.

4. The magnetic MEMS switch of claim 3, wherein the non-uniform cross section has the shape of an ellipse in the plan view.

5. The magnetic MEMS switch of claim 3, wherein the at least one permeable feature having non-uniform cross section comprises two permeable features having non-uniform cross section, wherein the shape of the permeable features is substantially elliptical over at least a portion of the two permeable features as seen in plan view, and wherein the minimum distance between the two permeable features is less than or equal to the maximum width of the elliptical shape, and wherein the minimum distance occurs below the shunt bar.

6. The magnetic MEMS switch of claim 1, wherein the magnetic feature is at least one of a permanent magnetic material and a permeable magnetic material.

7. The magnetic MEMS switch of claim 1, wherein the at least one magnetic feature are two magnetic fluxguides disposed laterally adjacent to and substantially symmetrically about a center of the movable plate on the first substrate.

8. The magnetic MEMS switch of claim 1, wherein the movable plate is formed from the device layer of the silicon-on-insulator substrate, and affixed to the handle wafer of the silicon-on-insulator substrate by the oxide layer.

9. The magnetic MEMS switch of claim 1, wherein the movable plate further comprises a shunt bar which electrically connects two electrical contacts formed on the second substrate when the magnetic MEMS switch is closed, wherein the shunt bar is electrically isolated from other portions of the movable plate.

10. The magnetic MEMS switch of claim 1, further comprising:

a metal alloy which bonds the first substrate to the second substrate.

* * * * *